US010964273B2

(12) United States Patent
Oh et al.

(10) Patent No.: US 10,964,273 B2
(45) Date of Patent: Mar. 30, 2021

(54) PIXEL SENSING DEVICE, ORGANIC LIGHT EMITTING DISPLAY DEVICE, AND PIXEL COMPENSATION METHOD THEREOF

(71) Applicant: LG Display Co., Ltd., Seoul (KR)

(72) Inventors: Hyemi Oh, Paju-si (KR); Minkyu Song, Paju-si (KR); Jisu Choi, Paju-si (KR); Byungjae Lee, Paju-si (KR); Myunggi Lim, Paju-si (KR); Kyoungdon Woo, Paju-si (KR); Seungtae Kim, Paju-si (KR); Bumsik Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/593,182

(22) Filed: Oct. 4, 2019

(65) Prior Publication Data

US 2020/0111424 A1 Apr. 9, 2020

(30) Foreign Application Priority Data

Oct. 4, 2018 (KR) ..... 10-2018-0118558
Dec. 19, 2018 (KR) ..... 10-2018-0165076

(51) Int. Cl.
*G09G 3/3291* (2016.01)

(52) U.S. Cl.
CPC ... *G09G 3/3291* (2013.01); *G09G 2300/0426* (2013.01); *G09G 2300/0819* (2013.01); *G09G 2310/0291* (2013.01); *G09G 2310/08* (2013.01); *G09G 2320/0233* (2013.01); *G09G 2320/0295* (2013.01)

(58) Field of Classification Search
CPC ..... G09G 3/3291; G09G 3/3233; G09G 2300/0426; G09G 2300/0819; H01L 2924/00
See application file for complete search history.

(56) References Cited

U.S. PATENT DOCUMENTS

2006/0097791 A1* 5/2006 Shuler, Jr. ..... H03F 1/14 330/292
2016/0012798 A1* 1/2016 Oh ..... G09G 3/325 345/205

FOREIGN PATENT DOCUMENTS

KR 10-2016-0007971 A 1/2016
KR 10-2017-0081020 A 7/2017

* cited by examiner

*Primary Examiner* — Robert J Michaud
(74) *Attorney, Agent, or Firm* — Seed Intellectual Property Law Group LLP

(57) ABSTRACT

A pixel sensing device, an organic light emitting display device and a pixel compensation method thereof are disclosed. The pixel sensing device comprises a plurality of current integrators for sensing driving characteristics of pixels. Each current integrator comprises: an operational amplifier equipped with an inverting input terminal to which a first input voltage is applied according to a pixel current of the pixels, a non-inverting input terminal to which a second input voltage is applied according to the pixel current, and an output terminal through which an integral voltage corresponding to the pixel current is output; and a feedback capacitor connected between the inverting input terminal and the output terminal. The operational amplifier comprises: a pre-amplifying unit for lowering an amplifier input gain and being equipped with the inverting and non-inverting input terminals; and two gain amplifying units for receiving an output of the pre-amplifying unit and for making an amplifier output gain higher than the amplifier input gain.

14 Claims, 14 Drawing Sheets

FIG. 7

| | Type1 | | Type2 | |
|---|---|---|---|---|
| Gain | 74dB | | 78dB | |
| $Z_{in,closed}$ calculation | 3.32TΩ | | 5.54TΩ | |
| Ipix | 10nA | 10pA | 10nA | 10pA |
| Ileak | 12.7pA | 1.95fA | 2.9pA | 0.9fA |

PIXEL SENSING DEVICE, ORGANIC LIGHT EMITTING DISPLAY DEVICE, AND PIXEL COMPENSATION METHOD THEREOF

CROSS-REFERENCE TO RELATED APPLICATION

This application claims the benefit of Korea Patent Application No. 10-2018-0118558 filed on Oct. 4, 2018, and Korea Patent Application No. 10-2018-0165076 filed on Dec. 19, 2018, which are incorporated herein by reference for all purposes as if fully set forth herein.

BACKGROUND

Technical Field

The present disclosure relates to an organic light emitting display device, and particularly to a pixel sensing device and a pixel compensation method.

Description of the Related Art

An active matrix organic light emitting display device includes organic light emitting diodes OLEDs capable of emitting light by themselves and has many advantages, such as a fast response time, a high emission efficiency, a high luminance, a wide viewing angle, and the like.

The organic light emitting display device arranges pixels each including an OLED in a matrix form and adjusts a luminance of the pixel based on a grayscale of video data. Each pixel includes a driving thin film transistor TFT controlling a pixel current flowing through the OLED based on a voltage Vgs between a gate electrode and a source electrode of the driving TFT. The driving characteristics of the OLED and the driving TFT are changed by temperature or deterioration. If the driving characteristics of the OLED and/or the driving TFT are different by each pixel, even if the same image data is written to pixels, the luminance between the pixels is different, so that it is difficult to realize a desired image quality.

An external compensation scheme is well-known for compensating for the change of the driving characteristics of the OLED or the driving TFT. The external compensation scheme senses the change of the driving characteristics of the OLED or the driving TFT and modulates image data based on the sensing results.

BRIEF SUMMARY

The organic light emitting device uses a current integrator to sense a pixel current corresponding to driving characteristics of the OLED or the driving TFT. The current integrator includes an operational amplifier, and a feedback capacitor connected between an inverting input terminal and a non-inverting input terminal of the operational amplifier. An amount of changes of the pixel current may be determined through a sensing voltage accumulated in the feedback capacitor during a predetermine time (sensing time) when the pixel current is input to the inverting input terminal of the operational amplifier. Since an input impedance of the operational amplifier is not infinite, the pixel current cannot all be transferred to the feedback capacitor, a part of the pixel current may flow into the inside of the operational amplifier to be a leakage current.

The pixel current is becoming smaller according to the trend of a high resolution and a high definition. As known from an equation C*V=I*T (C is a capacitance of the feedback capacitor, V is an output voltage, I is a pixel current and T is a sensing time), the capacitance of the feedback capacitor must be designed to be small, in order to sense a fine current while maintaining the sensing time and the output voltage (or sensing voltage) to be constant. However, if the capacitance of the feedback capacitor becomes smaller, an impedance of the feedback capacitor may become large to a level of an input impedance of the operational amplifier. Then, since the leakage current flowing into the operational amplifier increases instead the pixel current applied to the feedback capacitor is reduced, it comes to be impossible to accurately sense the pixel current. If a sensing performance is lowered, the driving characteristics of the OLED and/or the driving TFT cannot be compensated accurately.

Meanwhile, a process variation depending on positions of a panel may be further included as a factor for lowering screen uniformity, as well as the changes of the driving characteristics of the OLED or the driving TFT. The process variation includes deposition thickness variations of TFT and pixel components depending on the panel position. This indicates a capacitance variation of a capacitor connected to a gate electrode of the driving TFT. Unless the capacitance variation is compensated, a compensation performance for the driving TFT may be lowered.

Accordingly, the present disclosure provides a pixel sensing device capable of reducing a leakage current by increasing an input impedance of an operational amplifier included in a current integrator and an organic light emitting display device including the same.

Furthermore, the present disclosure provides a pixel sensing method which can improve a compensation performance by further compensating for a capacitance variation of a capacitor connected to a gate electrode of a driving TFT as well as a characteristic variation of the driving TFT, and an organic light emitting display device to which the pixel sensing method is applied.

The pixel sensing device according to the present disclosure comprises a plurality of current integrators for sensing driving characteristics of pixels. Each current integrator comprises: an operational amplifier equipped with an inverting input terminal to which a first input voltage is applied according to a pixel current of the pixels, a non-inverting input terminal to which a second input voltage is applied according to the pixel current, and an output terminal through which an integral voltage corresponding to the pixel current is output; and a feedback capacitor connected between the inverting input terminal and the output terminal. The operational amplifier comprises: a pre-amplifying unit for lowering an amplifier input gain and being equipped with the inverting and non-inverting input terminals; and two gain amplifying units for receiving an output of the pre-amplifying unit and for making an amplifier output gain higher than the amplifier input gain.

The present disclosure also provides an organic light emitting display device, comprising: a display panel equipped with pixels and sensing lines and data lines connected to the pixels; a data driving circuit configured to supply a data voltage for sensing to the data lines; the above pixel sensing device; and a timing controller configured to compensate for digital image data to be written on the display panel based on a sensing result of the pixel sensing device, wherein the pixel sensing device is configured to sense, through the sensing lines, a pixel current which flows in each pixel responding to the data voltage for sensing, and sense, through the data lines, a total amount of charges accumulated in capacitors of each pixel responding to the data voltage for sensing.

The present disclosure also provides a pixel compensation method of an organic light emitting display device, the organic light emitting display device comprising: pixels; the pixel sensing device connected the pixels through sensing lines and data lines, a data driving circuit for supplying a data voltage for sensing to the data lines, and a timing controller for compensating for digital image data to be written to the pixels based on a sensing result of the pixel sensing device, the pixel compensation method comprising: by the pixel sensing device, sensing, through the sensing lines, a pixel current which flows in each pixel responding to the data voltage for sensing; by the timing controller, calculating a first compensation parameter corresponding to a first sensing result of the pixel sensing device for the pixel current, and compensating for the digital image data to be written to the pixels based on the first compensation parameter; by the pixel sensing device, sensing, through the data lines, a total amount of charges accumulated in capacitors of each pixel responding to the data voltage for sensing; and by the timing controller, calculating a second compensation parameter corresponding to a second sensing result of the pixel sensing device for the pixel current, and further compensating for the digital image data to be written to the pixels based on the second compensation parameter.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings:

FIG. 7 compares a specification of the two-staged operational amplifier in FIG. 5 with that of the three-staged operational amplifier in FIG. 6.

DETAILED DESCRIPTION

Figure 1:
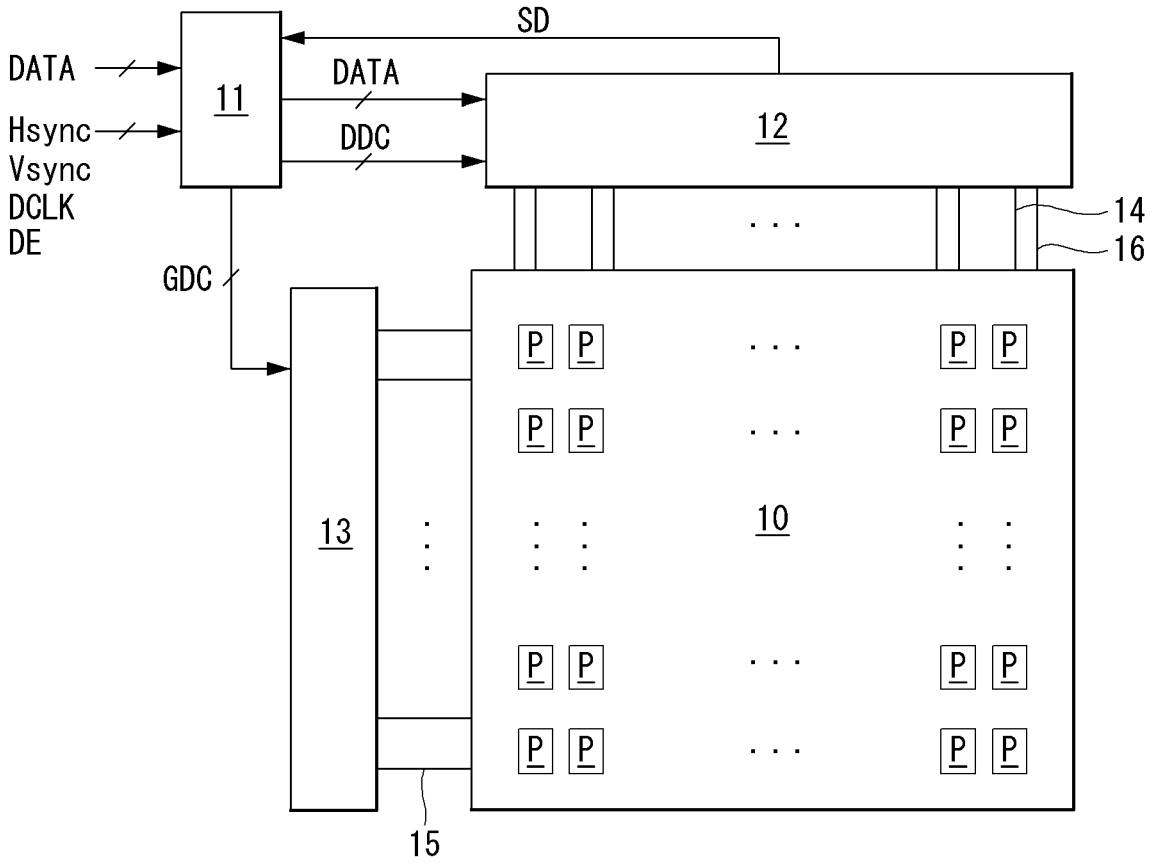
FIG. 1 shows a block diagram illustrating an organic light emitting display device according to an embodiment of the present disclosure.

The advantages and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, percentages, angles, numbers, etc., shown in the figures to describe the exemplary embodiments of the present disclosure are merely examples and not limited to those shown in the figures. Like reference numerals denote like elements throughout the specification. When the terms 'comprise,' 'have,' 'include' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on,' 'over,' 'under,' 'next to' and the like, one or more parts may be positioned between the two parts as long as the term 'immediately' or 'directly' is not used.

It will be understood that, although the terms "first," "second," etc., may be used to describe various elements, these elements should not be limited by these terms. These terms are only used to distinguish one element from another element. Thus, a first element referred to below may be a second element within the scope of the present disclosure.

Same reference numerals substantially denote same elements throughout the specification.

In this specification, the pixel circuit and the gate driver formed on the substrate of a display panel may be implemented by a TFT of an N-type MOSFET structure, but the present disclosure is not limited thereto so the pixel circuit and the gate driver may be implemented by a TFT of a P-type MOSFET structure. The TFT or the transistor is the element of 3 electrodes including a gate, a source and a drain. The source is an electrode for supplying a carrier to the transistor. Within the TFT, the carrier begins to flow from the source. The drain is an electrode from which the carrier exits the TFT. That is, the carriers in the MOSFET flow from the source to the drain. In the case of the N-type MOSFET NMOS, since the carrier is an electron, the source voltage has a voltage lower than the drain voltage so that electrons can flow from the source to the drain. In the N-type MOSFET, a current direction is from the drain to the source because electrons flow from the source to the drain. On the other hand, in the case of the P-type MOSFET PMOS, since the carrier is a hole, the source voltage has a voltage higher than the drain voltage so that holes can flow from the source to the drain. In the P-type MOSFET, a current direction is from the source to the drain because holes flow from the source to the drain. It should be noted that the source and drain of the MOSFET are not fixed. For example, the source and drain of the MOSFET may vary depending on the applied voltage.

Hereinafter, various embodiments of the present disclosure will be described in detail with reference to the accompanying drawings. In the following embodiments, an electroluminescent display device will be described mainly with respect to an organic light emitting display device including organic light emitting material. However, the present disclosure is not limited to the organic light emitting display device, but may be applied to an inorganic light emitting display device including inorganic light emitting material.

In describing the present disclosure, detailed descriptions of well-known functions or configurations related to the present disclosure will be omitted to avoid unnecessary obscuring the present disclosure.

Figure 2:
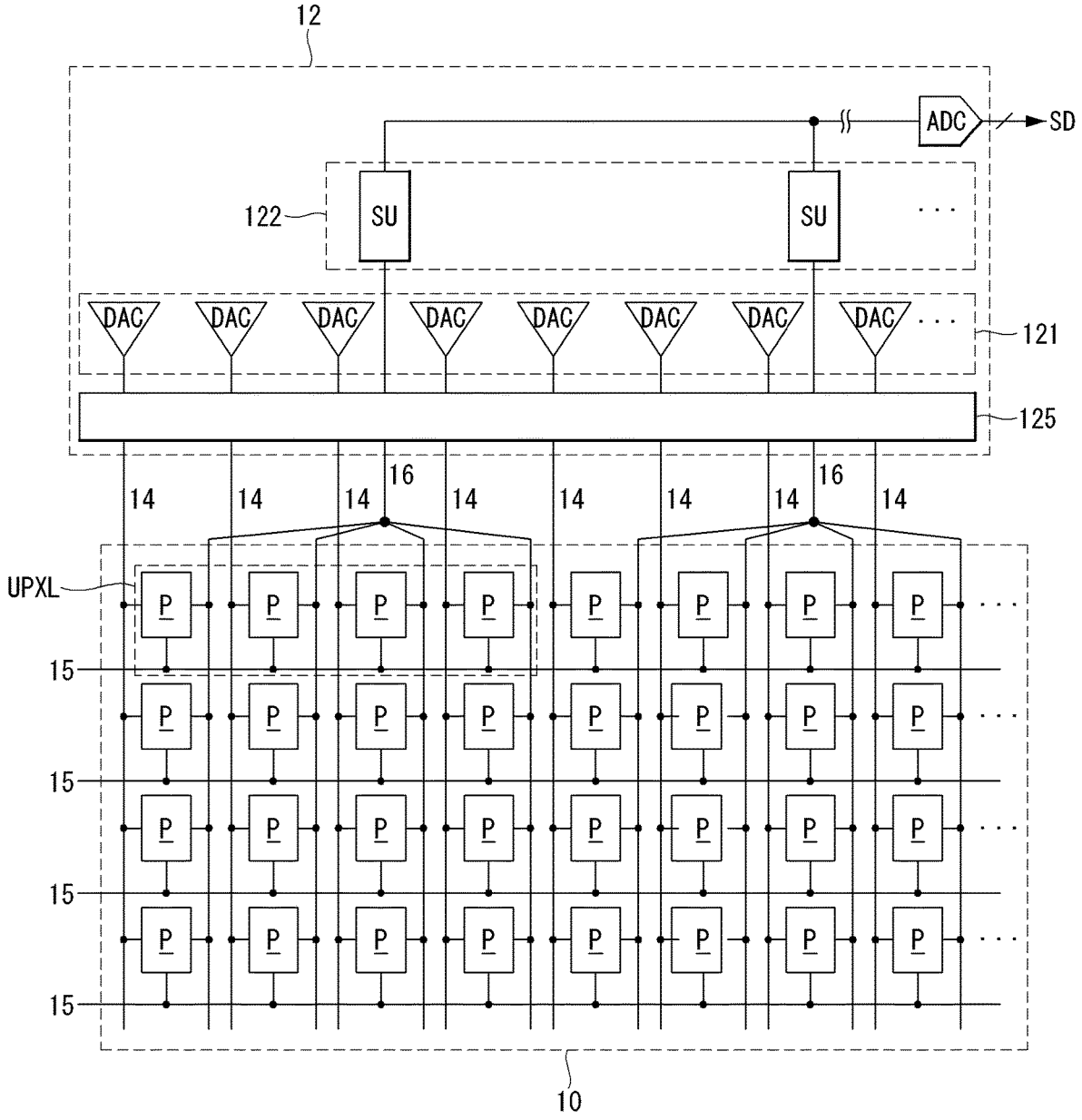
FIG. 2 shows a connecting configuration of the data driving circuit including the pixel sensing device of the present disclosure and a pixel array.
Figure 3:
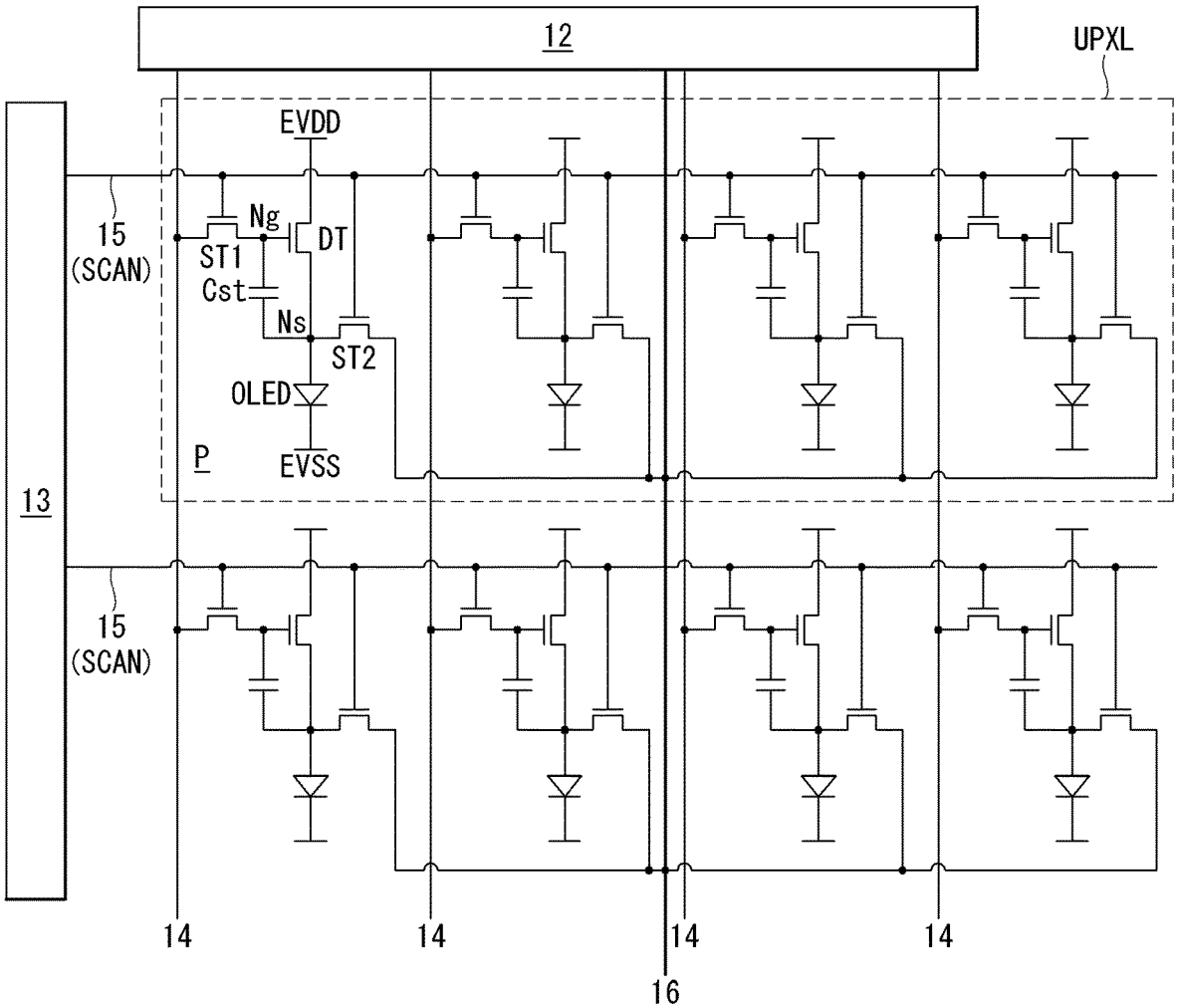
FIG. 3 shows a connecting configuration of pixels constituting the pixel array.
Figure 4:
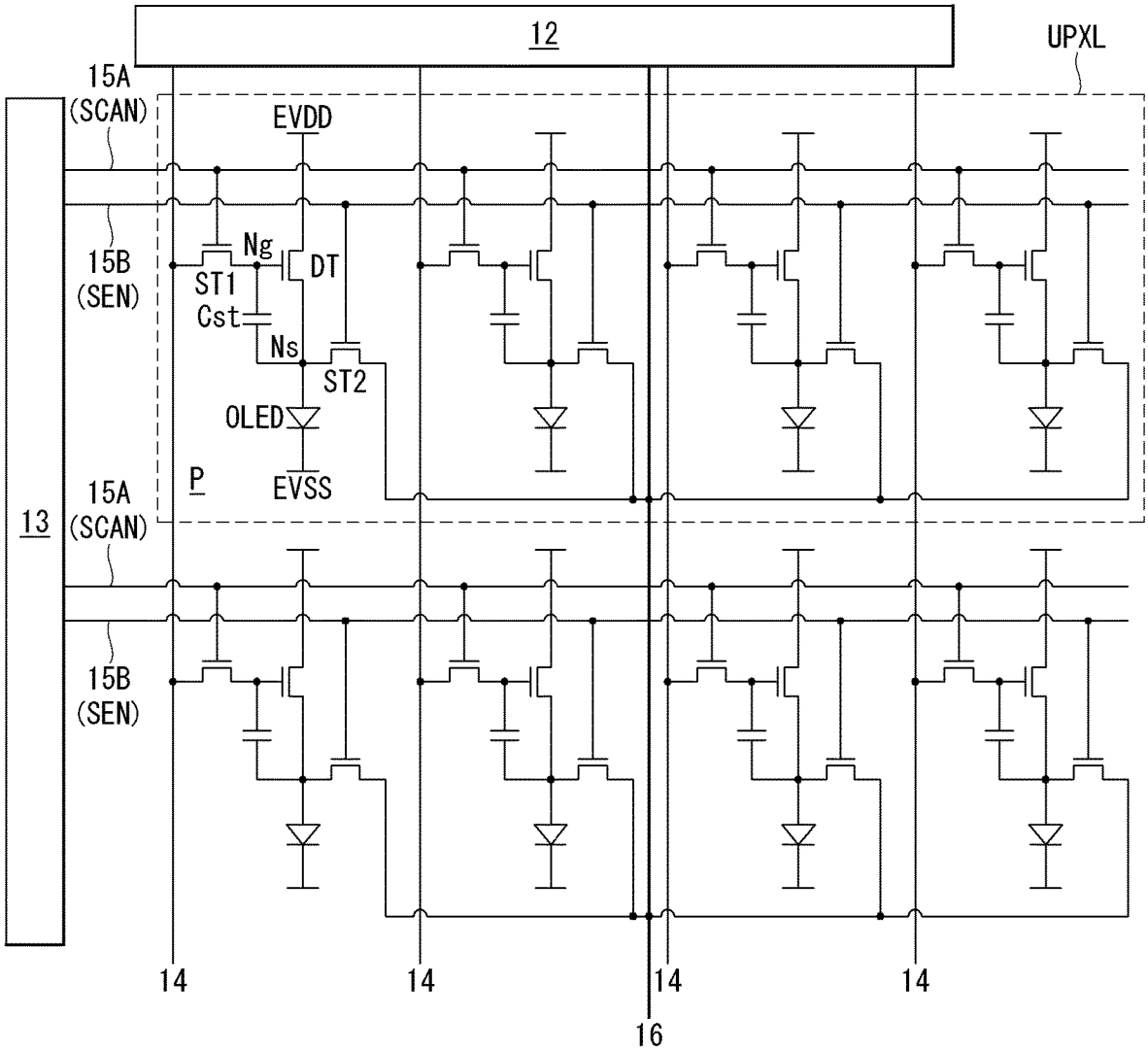
FIG. 4 shows another connecting configuration of the pixels constituting the pixel array.

FIG. 1 shows a block diagram illustrating an organic light emitting display device according to an embodiment of the present disclosure, FIG. 2 shows the connecting configuration of the data driving circuit including the pixel sensing device of the present disclosure and a pixel array, and FIGS. 3 and 4 show various connecting configurations of the pixels constituting the pixel array.

Referring to FIGS. 1 to 4, the organic light emitting display device according to the embodiment of the present disclosure may comprise a display panel 10, a timing controller 11 and a data driving circuit 12 and a gate driving circuit 13. The data driving circuit 12 includes a current sensing circuit (pixel sensing device) 122 according to an embodiment of the present disclosure.

A plurality of data lines 14 and sensing lines 16 and a plurality of gate lines 15 cross each other on the display panel 10, and the pixels for sensing P are arranged in a matrix form to form a pixel array. As shown in FIG. 4, the plurality of gate lines 15 may comprise a plurality of first gate lines 15A to which scan control signals SCAN are supplied and a plurality of second gate lines 15B to which sense control signals SEN are supplied. When the scan control signal SCAN and the sense control signals SEN are of a same phase to each other, the first and second gate lines 15A and 15B may be unified into one gate line 15 as shown in FIG. 3.

Each pixel P may be connected to one of the data lines 14, one of the sensing lines 16 and one of the gate lines 15. The pixels P constituting the pixel array may comprise the red pixels for displaying red color, the green pixels for displaying green color, the blue pixels for displaying blue color and the white pixels for displaying white color. Four pixels including the red pixel, the green pixel, the blue pixel and the white pixel may constitute one pixel unit UPXL. But, the configuration of the pixel unit UPXL is not limited thereto. The plurality of pixels P constituting a same pixel unit UPXL may share one sensing line 16. Although not shown in the figure, a plurality of pixels P constituting the same pixel unit UPXL may be independently connected to different sensing lines. Each pixel P receives a high power voltage EVDD and a low power voltage EVSS from a power generator.

As shown in FIGS. 3 and 4, the pixel according to the present disclosure may comprise an OLED, a driving TFT DT, a storage capacitor Cst, a first switch TFT ST1 and a second switch TFT ST2, but is not limited thereto. The TFTs may be implemented of a P-type, an N-type or a hybrid-type in which the P-type and the N-type are mixed. The semiconductor layer of the TFT may include amorphous silicon, polysilicon, or an oxide.

The OLED is a light-emitting element. The OLED may include an anode electrode connected to a source node Ns, a cathode electrode connected to an input terminal of a low potential pixel voltage source EVSS, and an organic compound layer disposed between the anode electrode and the cathode electrode. The organic compound layer may include a hole injection layer HIL, a hole transport layer HTL, an emission layer EML, an electron transport layer ETL, and an electron injection layer EIL.

The driving TFT DT controls the magnitude of the current flowing from a source electrode to a drain electrode to be input to the OLED according to the voltage difference Vgs between a gate electrode and the source electrode. The driving TFT DT comprises the gate electrode connected to a gate node Ng, the drain electrode connected to the input terminal of the high power voltage EVDD and the source electrode connected to a source node Ns. The storage capacitor Cst is connected between the gate node Ng and the source node Ns to hold the voltage Vgs between the gate and source electrodes of the driving TFT DT for a period of time. The first switch TFT ST1 switches the electric connection between the data line 14 and the gate node Ng according to the scan control signal SCAN. The first switch TFT ST1 comprises a gate electrode connected to the first gate line 15A, a first electrode connected to the data line 14 and a second electrode connected to the gate node Ng. The second switch TFT ST2 switches the electric connection between the sensing line 16 and the source node Ns according to the sense control signal SEN. The second switch TFT ST2 is equipped with a gate electrode connected to the second gate line 15B, a first electrode connected to the sensing line 16 and a second electrode connected to the source node Ns.

The first gate line 15A and the second gate line 15B may be unified into one gate line 15 (refer to FIG. 3). In this case, the scan control signal SCAN and the sense control signal SEN may have a same phase.

The organic light emitting display device including the pixel array adopts an external compensation scheme. The external compensation scheme senses the driving characteristics of the OLED and/or the driving TFT DT equipped in the pixels P and corrects input image data according to sensing values. The driving characteristic of the OLED means an operating point voltage of the OLED. The characteristic of the driving TFT DT means a threshold voltage and electron mobility of the driving TFT.

The external compensation scheme according to the present disclosure further includes the operations of sensing a total amount of charges accumulated in capacitors of each pixel P responding to a data voltage for sensing and correcting the input image data DATA according to sensing values. Here, the capacitors include a parasitic capacitor and a storage capacitor Cst coupled to the gate electrode of the driving TFT DT included in each pixel P.

The total capacitance of the capacitors connected to the gate electrode of the driving TFT DT may vary between the pixels P depending on a deposition thickness of the driving TFT. In this case, even though applying a same data voltage for sensing to pixels P, there may be a variation in a total amount of charges accumulated in the capacitors in respective pixels P. In the present disclosure, by sensing a capacitance difference between pixels P and further correcting input image data DATA based on the sensing results, the compensation performance may be remarkably improved. The organic light emitting display device according to the present disclosure performs an image display operation and the external compensation operation. The external compensation operation may be performed in a vertical blank interval during the image displaying operation, in a power on sequence before image display starts or in a power off sequence after the image display ends. The vertical blank interval is a period in which image data is not written, and disposed between vertical active intervals in which image data is written. The power on sequence means the period until image is displayed immediately after driving power is applied. The power off sequence means the period until the driving power is turned off immediately after the image display is terminated.

The timing controller 11 generates the data control signals DDC for controlling the operating timings of the data driving circuit 12 and the gate control signals GDC for controlling the operating timings of the gate driving circuit 13, based on the timing signals such as a vertical synchronization signal Vsync, a horizontal synchronization signal Hsync, a dot clock signal DCLK, a data enable signal DE and the like. The timing controller 11 may temporally separates a period during which the image displaying operation is performed and a period during which the external compensation operation is performed and generate the control signals DDC and GDC for the image displaying operation and the control signals DDC and GDC for the external compensation operation.

The gate control signals GDC may include a gate start pulse GSP, a gate shift clock GSC, and so on. The gate start pulse GSP is applied to the gate stage of generating a first scan signal to control the gate stage to generate the first scan signal. The gate shift clock GSC is commonly supplied to the gate stages to shift the gate start pulse GSP.

The data control signals DDC includes a source start pulse SSP, a source sampling clock SSC, a source output enable signal SOE, and so on. The source start pulse SSP controls a data sampling start timing of the data driving circuit 12. The source sampling clock SSC controls a sampling timing of data in respective source drive ICs, based on a rising or falling edge. The source output enable signal SOE controls an output timing of the data driving circuit 12. The data control signals DDC may further include various signals for controlling the operation of the current sensing circuit or device 122 included in the data driving circuit 12.

The timing controller 11 receives a digital sensing result value SD according to the external compensation operation from the data driving circuit 12. The timing controller may compensate for the deterioration deviation of the driving TFT or the deterioration deviation of the OLED between the pixels P by correcting input image data DATA based on the digital sensing result value SD. Also, the timing controller 11 may compensate for the deposition thickness variation of the driving TFT between the pixels P. The timing controller 11 transmits the corrected digital image data DATA to the data driving circuit 12.

The data driving circuit 12 includes at least one source driver IC. The source driver IC is equipped with a latch array, a plurality of digital-to-analog converters DAC 121 connected to each data lines 14, a current sensing device 122 connected to each sensing line through a sensing channel, and an analog-to-digital converter ADC.

The latch array latches the digital image data DATA input from the timing controller 11 and supplies it to the DAC, based on the data control signals DDC. The DAC converts the digital image data DATA input from the timing controller 11 into a data voltage for displaying and supplies it to the data line 14 when performing the image displaying operation. The DAC may generate the data voltage for sensing at a certain level and supply it to the data line 14 when performing the external compensation operation.

The pixel sensing device 122 includes a plurality of sensing circuits SU (which may be referred to herein as sensing units SU).

Each sensing unit SU serves to sense, through the sensing line 16, a pixel current flowing in each pixel P responding to a data voltage for sensing. Also, each sensing unit SU plays a role in sensing, through the data line 14, a total amount of charges which are accumulated in the capacitors of each pixel responding to the data voltage for sensing Each sensing unit SU may be implemented as a current sensing type including a current integrator. Each sensing unit SU has a configuration of a three-staged operational amplifier in order to increase an input impedance of an operational amplifier included in the current integrator. The input impedance of the three-staged operational amplifier is proportional to an amplifier output gain and inversely proportional to an amplifier input gain. So, the three-staged operational amplifier includes a pre-amplifying circuit or stage (which may be referred to herein as a pre-amplifying unit) (a first amplifying stage) lowering the amplifier input gain relatively, and two gain amplifying circuits or stages (which may be referred to herein as gain amplifying units) (second and third amplifying stages) increasing the amplifier output gain above the amplifier input gain. The sensing units SU constituting the pixel sensing device of the present disclosure will be described later in detail with reference to FIGS. 6 and 7 and FIGS. 11 to 12.

The gate driving circuit 13 generates the scan control signals SCAN based on the gate control signal GDC to match the image display operation and the external compensation operation and then supplies them to the first gate lines 15A. Also, the gate driving circuit 13 generates the sense control signals SEN based on the gate control signal GDC to match the image display operation and the external compensation operation and then supplies them to the second gate lines 15B. Or, the gate driving circuit 13 may generate the scan control signals SCAN and the sense control signals SEN of a same phase based on the gate control signal GDC to match the image display operation and the external compensation operation and then supplies them to the gate lines 15.

Figure 5:
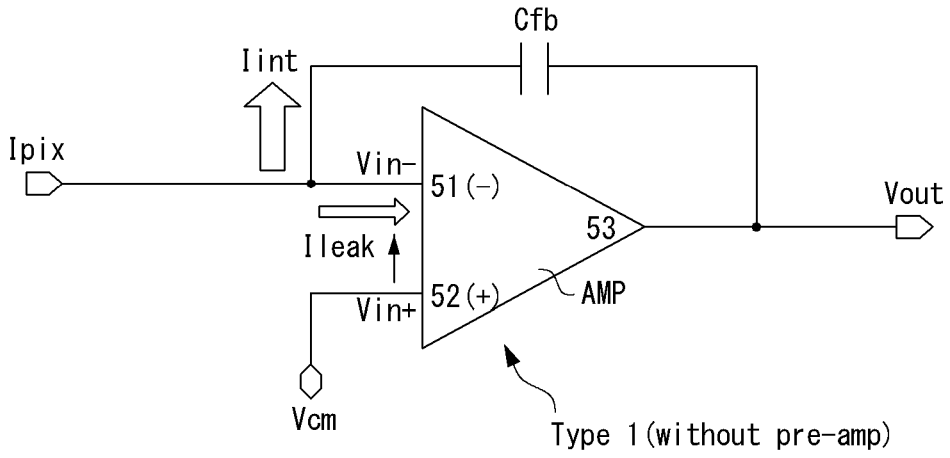
FIG. 5 simply shows a conventional current integrator including a two-staged operational amplifier excluding a pre-amplifying unit, as a comparative example to the present disclosure.
Figure 6:
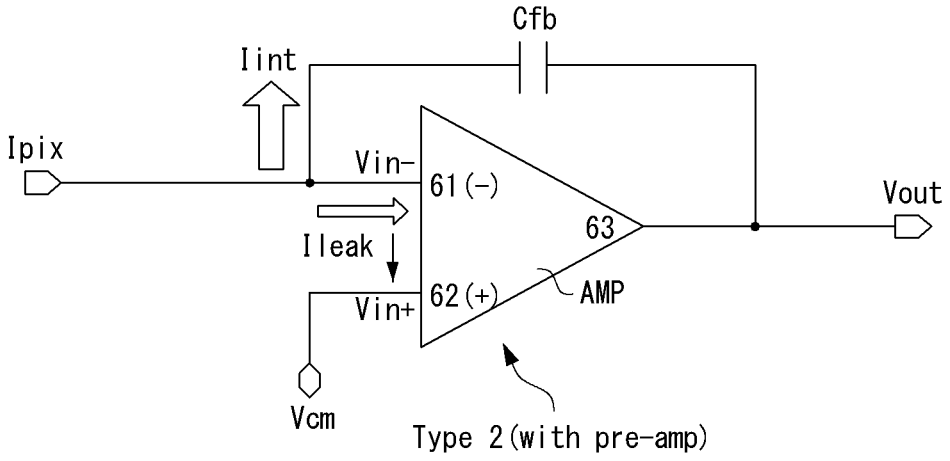
FIG. 6 is a sensing unit for implementing a pixel sensing device according to the present disclosure, and simply shows a current integrator including a three-staged operational amplifier including a pre-amplifying unit.

FIG. 5 simply shows a conventional current integrator including a two-staged operational amplifier excluding a pre-amplifying unit, as a comparative example to the present disclosure. FIG. 6 is a sensing unit for implementing a pixel sensing device according to the present disclosure, and simply shows a current integrator including a three-staged operational amplifier including a pre-amplifying unit. And, FIG. 7 compares a specification of the two-staged operational amplifier in FIG. 5 with that of the three-staged operational amplifier in FIG. 6.

In case of a current integrator having a two-staged operational amplifier AMP as shown in FIGS. 5 and 7, since there is no pre amplifier and the amplifier output gain is relatively low, an effective current component Iint applied to a feedback capacitor Cfb in the pixel current Ipix is reduced. And, since a leakage current component Ileak flowing into the operational amplifier AMP is increased instead the effective current component Iint being reduced, it is impossible to accurately sense the pixel current Ipix. If a sensing performance is deteriorated, the driving characteristics of the OLED and/or the driving TFT may not be compensated accurately.

On the other hand, in case of the current integrator of the present disclosure having the three-staged operational amplifier AMP as shown in FIGS. 6 and 7, the amplifier input gain is lowered due to an additional pre-amplifying unit and the amplifier output gain is relatively increased due to the two gain amplifying units. So, a leakage current component Ileak flowing into the operational amplifier AMP is remarkably reduced and the effective current component Iint flowing into the feedback capacitor Cfb is increased by the amount of the reduced leakage current component Ileak. Accordingly, more accurate sensing of the pixel current Ipix is possible compared to the current integrator having the two-staged operational amplifier.

Figure 8:
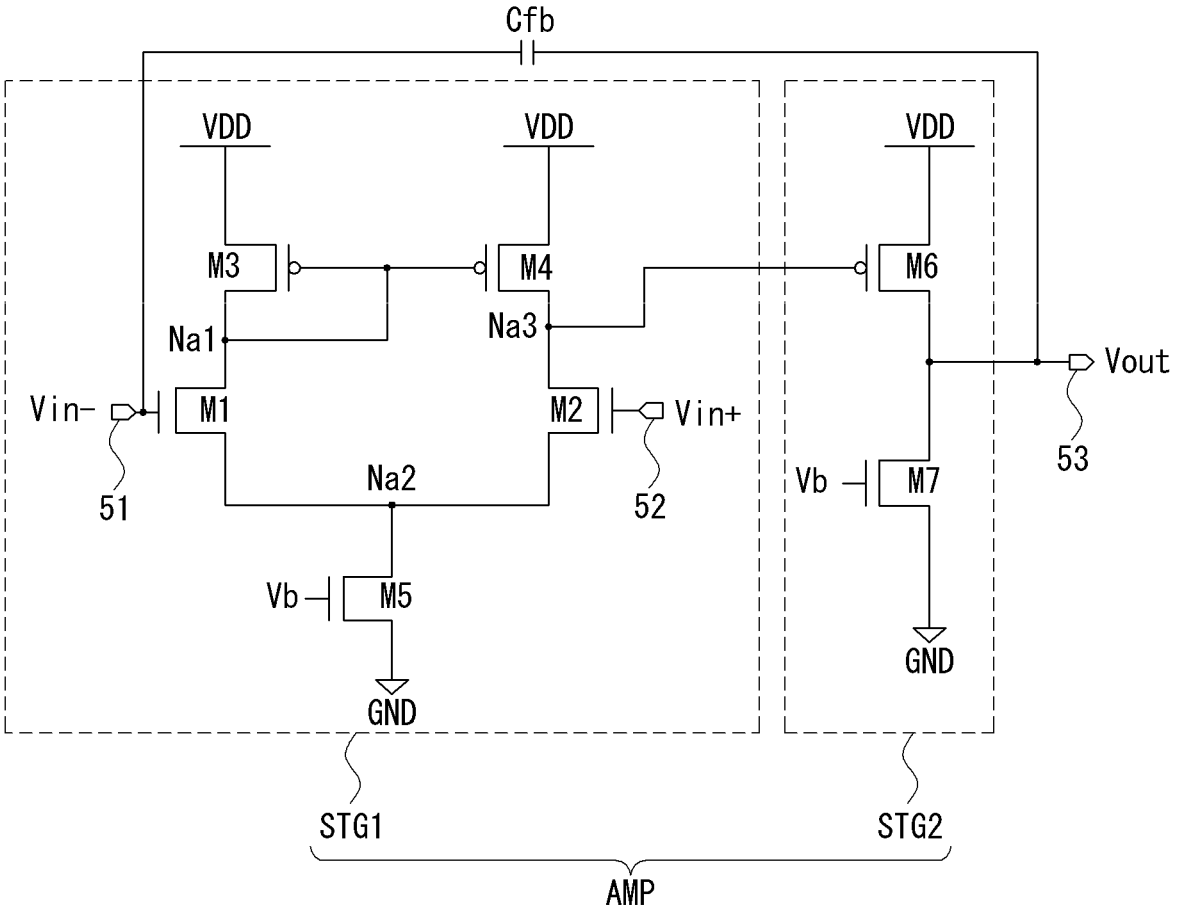
FIGS. 8 to 10 are views for explaining a configuration and an input impedance of the two-staged amplifier of FIG. 5.
Figure 9:
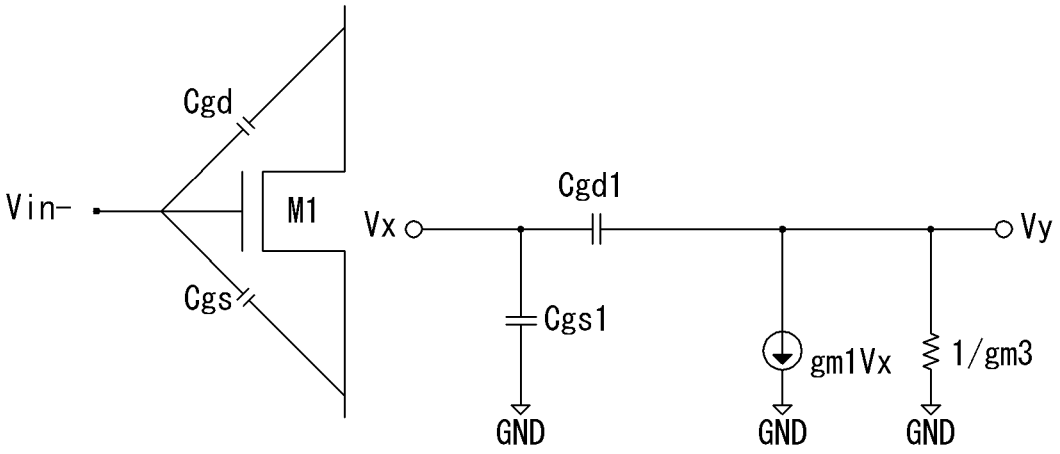
Figure 10:
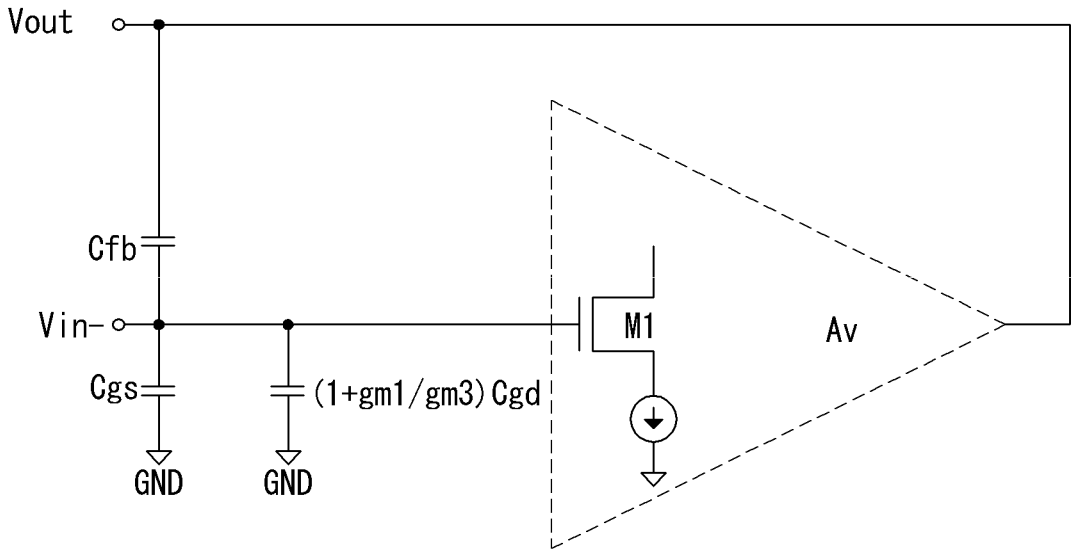

FIGS. 8 to 10 are views for explaining a configuration and an input impedance of the two-staged amplifier of FIG. 5.

Referring to FIG. 8, the current integrator according to the comparative example includes an operational amplifier AMP and a feedback capacitor Cfb. The operational amplifier AMP is equipped with an inverting input terminal 51 applied with a minus input voltage Vin− according to the pixel current, a non-inverting input terminal 52 applied with a plus input voltage Vin+ according to the pixel current and an output terminal 53 outputting an integral voltage Vout corresponding to the pixel current. The feedback capacitor Cfb is connected between the inverting input terminal 51 and the output terminal 53. The plus input voltage Vin+ means Vcm in FIG. 6.

The operational amplifier AMP includes a first amplifying stage STG1 for amplifying the amplifier output gain firstly and a second amplifying stage STG2 for amplifying the amplifier output gain secondarily.

The first amplifying stage STG1 is implemented by first to fifth MOS transistors M1 to M5. In the first MOS transistor M1, a gate electrode is connected to the inverting input terminal 51, a drain electrode is connected to a first node Na1, and a source electrode is connected to a second node Na2. In the second MOS transistor M2, a gate electrode is connected to the non-inverting input terminal 52, a drain electrode is connected to a third node Na3, and a source electrode is connected to a second node Na2. In the third MOS transistor M3, a gate electrode and a drain electrode are connected to the first node Na1, and a source electrode is connected to a high potential driving voltage source VDD. In the fourth MOS transistor M4, a gate electrode is connected to a first node Na1, a source electrode is connected to the high potential driving voltage source VDD, and a drain electrode is connected to the third node Na3. In the fifth MOS transistor M5, a gate electrode is connected to a bias voltage source Vb, a drain electrode is connected to the second node Na2, and a source electrode is connected to a low potential driving voltage source GND. Here, the first, second and fifth MOS transistors M1, M2 and M5 are implemented as an N-type, and the third and fourth MOS transistors M3 and M4 are implemented as a P-type.

The second amplifying stage STG2 is implemented by sixth and seventh MOS transistors M6 and M7. In the sixth MOS transistor M6, a gate electrode is connected to the third node Na3, a source electrode is connected to the high potential driving voltage source VDD, and a drain electrode is connected to the output terminal 53. In the seventh MOS transistor M7, a gate electrode is connected to the bias voltage source Vb, a drain electrode is connected to the output terminal 53, and a source electrode is connected to the low potential driving voltage source GND. Here, the sixth MOS transistor M6 is implemented as the P-type, and the seventh MOS transistor M7 is implemented as the N-type.

In this feedback structure of the operational amplifier AMP, if the first and third MOS transistors M1 and M3 affected by the minus input voltage Vin− are analyzed with respect to a small signal in order to obtain the input impedance, they may be expressed as shown in FIG. 9. In FIG. 9, Vx means a test voltage source for calculating the input impedance, gm1Vx means a current generated by the test voltage source Vx and the first MOS transistor M1 in the first amplifying stage STG1. And, gm1 means a transconductance of the first MOS transistor M1, gm3 means a transconductance of the third MOS transistor M3, Cgd means a parasitic capacitance between the gate and drain electrodes of the first MOS transistor M1, Cgs means a parasitic capacitance between the gate and source electrodes of the first MOS transistor M1, Cgs1 means a parasitic capacitance between the gate and source electrodes of the first MOS transistor M1, Cgd1 means a parasitic capacitance between the gate and drain electrodes of the first MOS transistor M1, and Vy means a test voltage source for calculating the input impedance.

The input impedance based on the first and third MOS transistors M1 and M3 of FIG. 9 may be modeled as shown in Equation 1. In Equation 1, Ix means a test current input to the first amplifying stage STG1 from the test voltage source Vx.

$$V_x = (I_X - gm_1 V_x)\frac{1}{g_{m3}} + \frac{I_x}{C_{gd1}s} \qquad \text{[Equation 1]}$$

$$\frac{V_x}{I_x} = \frac{1 + Cgd_1 s / gm_3}{C_{gd1}s\left(1 + \frac{g_{m1}}{g_{m3}}\right)}$$

$$\therefore Z_{in} = Zx \,\|\, \frac{1}{C_{gs1}s}$$

Next, the input impedance ($Z_{in,\ closed}$) in the feedback circuit may be obtained as Equation 2 from a total small-signal model of the feedback circuit such as FIG. 10. In Equation 2, β is a feedback factor and means a magnitude that is fed back from the amplifier output terminal 53 to the inverting input terminal 51, and S means an angular frequency. And, Av means the amplifier output gain, and CF means a capacitance of the feedback capacitor.

$$Z_{in,closed} = Z_{in}(1 + \beta A_v) \qquad \text{[Equation 2]}$$

$$\beta = \frac{C_F}{C_F + C_{gs} + \left(1 + \frac{g_{m1}}{g_{m3}}\right)C_{gd}}$$

$$\therefore Z_{in,Closed} = \frac{1 + \frac{C_{gd}S}{g_{m3}}}{C_{gd}s\left(1 + \frac{g_{m1}}{g_{m3}}\right) + C_{gs}S\left(1 + \frac{C_{gd}S}{g_{m3}}\right)}(1 + \beta A_v)$$

As described with respect to FIG. 5, the input impedance (Zin, closed) must be increased in order to reduce the leakage current component Ileak. As known from Equation 2, the input impedance (Zin, closed) is determined based on the factor gm1/gm3 related to the amplifier input gain and βAv related to the amplifier output gain. So, in order to increase the input impedance (Zin, closed), gm1/gm3 must be reduced or βAv must be increased. In order to reduce gm1/gm3, the amplifier input gain must be reduced, and in order to increase βAv, the amplifier output gain must be increased.

Figure 11:
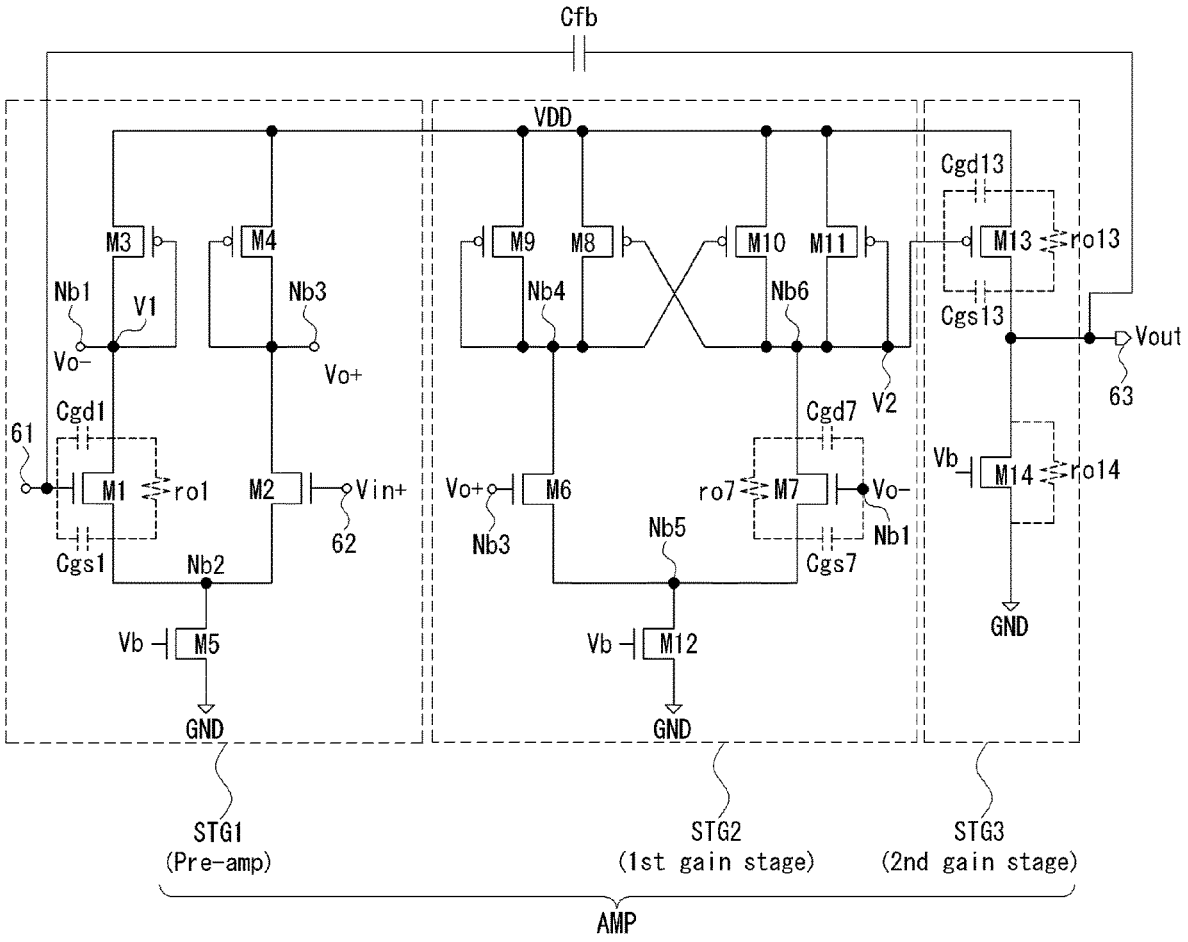
FIGS. 11 and 12 are views for explaining a configuration and an input impedance of the three-staged amplifier of FIG. 6.
Figure 12:
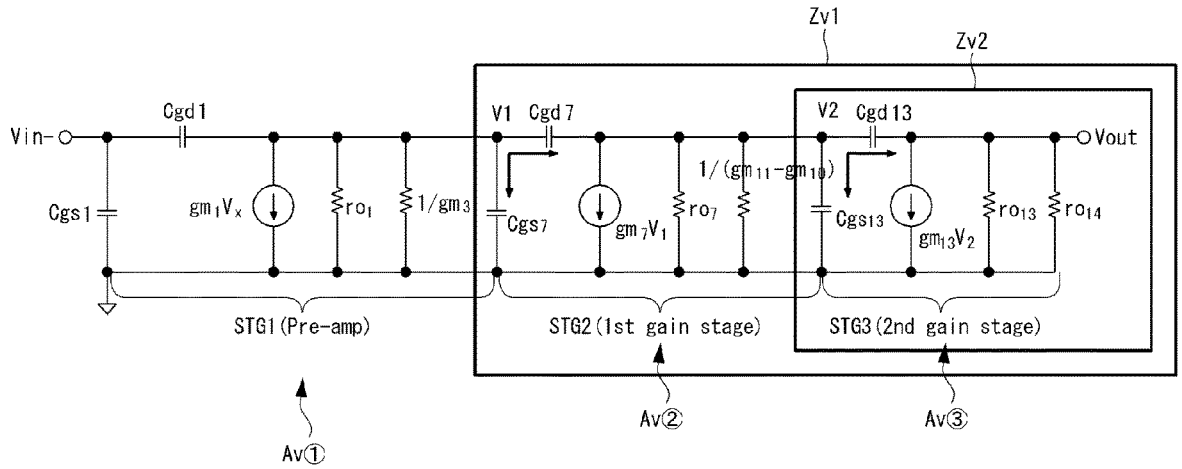

FIGS. 11 and 12 are views for explaining a configuration and an input impedance of the three-staged amplifier of FIG. 6.

Referring to FIG. 11, the current integrator according to an embodiment of the present disclosure includes an operational amplifier AMP and a feedback capacitor Cfb. The operational amplifier AMP is equipped with an inverting input terminal 61 applied with a minus input voltage Vin− according to the pixel current, a non-inverting input terminal 62 applied with a plus input voltage Vin+ according to the pixel current and an output terminal 63 outputting an integral voltage Vout corresponding to the pixel current. The feedback capacitor Cfb is connected between the inverting input terminal 61 and the output terminal 63.

The operational amplifier AMP has a three-staged configuration including first to third amplifying stages STG1. The first amplifying stage STG1 of the operational amplifier AMP is a pre-amplifying unit and serves to lower the amplifier input gain. The second and third amplifying stages STG2 and STG3 are first and second gain amplifying units and serve to amplify the amplifier output gain much more than the amplifier input gain.

The pre-amplifying unit STG1 includes an inverting input terminal 61 and a non-inverting input terminal 62 and is implemented by first to fifth MOS transistors M1 to M5. In the first MOS transistor M1, a gate electrode is connected to the inverting input terminal 61, a drain electrode is connected to a first node Nb1, and a source electrode is connected to a second node Nb2. In the second MOS transistor M2, a gate electrode is connected to the non-inverting input terminal 62, a drain electrode is connected to a third node Nb3, and a source electrode is connected to the second node Nb2. In the third MOS transistor M3, gate and drain electrodes are connected to the first node Nb1, and a source electrode is connected to a high potential driving voltage source VDD. In the fourth MOS transistor M4, gate and drain electrodes are connected to the third node Nb3, and a source electrode is connected to high potential driving voltage source VDD. And, in the fifth MOS transistor M5, a gate electrode is connected to a bias voltage source Vb, a drain electrode is connected to the second node Nb2, and a source electrode is connected to a low potential driving voltage source GND. Here, the first node Nb1 corresponds to an inverting output voltage Vo− of the pre-amplifying unit STG1, and the third node Nb3 corresponds to a non-inverting output voltage Vo+ of the pre-amplifying unit STG1. In order to secure operating security, the first, second and fifth MOS transistors M1, M2, and M5 are implemented as the N-type, and the third and fourth MOS transistors M3 and M4 are implemented as the P-type.

The first gain amplifying unit STG2 receives the outputs Vo− and Vo+ of the pre-amplifying unit STG1, and raises an amplifying output gain by a first value through MOS transistors M8 to M11 connected with each other in a differential diode manner. The first gain amplifying unit STG2 amplifies the amplifier output gain much more than the first amplifying stage STG1 in FIG. 8. Specifically, an amplifying degree (gain) of the first amplifying stage STG1 of FIG. 8 is expressed in gm(ro1||ro2) form, but the amplifying degree (gain) of the first gain amplifying unit STG2 of the disclosure may be expressed in gm7*ro*7 form when assuming that gm11 is same as gm10. If the circuits in FIG. 8 and FIG. 11 have same gm and ro, gm7*ro*7 is much greater than gm(ro1||ro2).

The first gain amplifying unit STG2 is implemented by sixth to twelfth MOS transistors M6 to M12. In the sixth MOS transistor M6, a gate electrode is connected to third the node Nb3, a drain electrode is connected to a fourth node Nb4, and a source electrode is connected to a fifth node Nb5. In the seventh MOS transistor M7, a gate electrode is connected to the first node Nb1, a drain electrode is connected to a sixth node Nb6, and a source electrode is connected to the fifth node Nb5. In the eighth MOS transistor M8, a gate electrode is connected to the sixth node Nb6, a source electrode is connected to the high potential driving voltage source VDD, and a drain electrode is connected to the fourth node Nb4. In the ninth MOS transistor M9, gate and drain electrodes are connected to the fourth node Nb4, and a source electrode is connected to the high potential driving voltage source VDD. In the tenth MOS transistor M10, a gate electrode is connected to the fourth node Nb4, a source electrode is connected to the high potential driving voltage source VDD, and a drain electrode is connected to the sixth node Nb6. In the eleventh MOS transistor M11, gate and drain electrodes are connected to the sixth node Nb6 and a source electrode is connected to the high potential driving voltage source VDD. And, in the twelfth MOS transistor M12, a gate electrode is connected to the bias voltage source Vb, a drain electrode is connected to the fifth node Nb5, and a source electrode is connected to the low potential driving voltage source GND. In order to secure operating security, the sixth, seventh and twelfth MOS transistors M6, M7, and M12 are implemented as the N-type, and the eighth to eleventh MOS transistors M8 to M11 are implemented as the P-type.

The second gain amplifying unit STG3 has an output terminal 63 and is connected to the first gain amplifying unit STG2 through the sixth node Nb6. The second gain amplifying unit STG3 raises the amplifier output gain by a second value, and the second value is less than the first value of the first gain amplifying unit STG2. The second gain amplifying unit STG3 may have an amplifying degree (gain) similar to the second amplifying stage STG2 in FIG. 8.

The second gain amplifying unit STG3 is implemented by thirteenth and fourteenth MOS transistors M13 and M14. In the thirteenth MOS transistor M13, a gate electrode is connected to the sixth node Nb6, a source electrode is connected to the high potential driving voltage source VDD, and a drain electrode is connected to the output terminal 63. In the fourteenth MOS transistor M14, a gate electrode is connected to the bias voltage source Vb, a drain electrode is connected to the output terminal 63, and a source electrode is connected to the low potential driving voltage source GND. Here, in order to secure operating security, the thirteenth MOS transistor M13 is implemented as the P-type, and the fourteenth MOS transistor M14 is implemented as the N-type.

Since the operational amplifier AMP has a symmetric structure, a half circuit analyzing method may be applied in which the circuit constituting the operational amplifier AMP is analyzed by dividing the circuit on the basis of a tail current of the fifth and twelfth MOS transistors M5 and M12. Accordingly, the present disclosure may calculate an input impedance by applying the half circuit analyzing method on the basis of the minus input voltage Vin− in the above-described feedback structure of the operational amplifier AMP. If the operational amplifier AMP is analyzed with respect to a small signal according to the half circuit analyzing method, it may be expressed such as FIG. 12.

In FIG. 12, V1 means an inverting output voltage Vo− of the pre-amplifying unit STG1, V2 means a voltage applied to the sixth node Nb6, and Vx means a test voltage source for calculating the input impedance. And, gm1, gm3, gm10, gm11 and gm13 respectively mean trans-conductances of the first, third, tenth, eleventh and thirteenth MOS transistors M1, M3, M10, M11 and M13. Also, gm1Vx means a test current input to the gate electrode of the first MOS transistor M1, gm7V1 means an operating current input to the gate electrode of the seventh MOS transistor M7, and gm13V2 means an operating current input to the gate electrode of the thirteenth MOS transistor M13. Cgd1 means a parasitic capacitance between the gate and drain electrodes of the first MOS transistor M1, and Cgs1 means a parasitic capacitance between the gate and source electrodes of the first MOS transistor M1. Cgd7 means a parasitic capacitance between the gate and drain electrodes of the seventh MOS transistor M7, and Cgs7 means a parasitic capacitance between the gate and source electrodes of the seventh MOS transistor M7. And, ro1 means an impedance seeing from the drain electrode of the first MOS transistor M1, ro7 means an impedance seeing from the drain electrode of the seventh MOS transistor M7, ro13 means an impedance seeing from the drain electrode of the thirteenth MOS transistor M13, and ro14 means an impedance seeing from the drain electrode of the fourteenth MOS transistor M14.

In the small-signal modeling result of FIG. 12, the impedances Zv1 and Zv2 based on V1 and V2 are same as Equation 3. In Equation 3, Zv2 may be expressed by the impedance components Cgs13, Cgd13, gm13V2, ro13 and ro14 seen from V2 in a right direction, and Zv1 may be expressed by the impedance components Cgs7, Cgd7, gm7V1, ro7, 1/(gm11−gm10) and Zv2 seen from V1 in the right direction In Equation 3, ro13||ro14 means an impedance applied to the amplifier output terminal 63 of the second gain amplifying unit STG3, and also means a parallel connection of ro13 and ro14 which are respectively seen from the drain electrodes of the thirteenth and fourteenth MOS transistors M13 and M14.

$$Z_{v2} = \frac{1}{C_{gs13} + (1 + g_{m13}(r_{o13} \parallel r_{o14}))C_{gd13}} \qquad \text{[Equation 3]}$$

$$Z_{v1} = C_{gs7} \parallel \frac{V_{v1}}{I_{v1}}$$

Vv1/Iv1 of Equation 3 is again expressed such as Equation 4. Vv1/Iv1 is impedance calculated by excluding Cgs7 from Zv1. In Equation 4, S means respective frequencies.

$$\frac{V_{v1}}{I_{v1}} = \frac{1 + C_{gd7}\dfrac{1}{r_{o7}\left\|\dfrac{1}{g_{m11} - gm_{10}}\right\| Z_{v2}}}{C_{gd7}s\left(1 + gm_7\left(\dfrac{1}{r_{o7}\left\|\dfrac{1}{g_{m11} - g_{m10}}\right\| Z_{v2}}\right)\right)} \qquad \text{[Equation 4]}$$

An input impedance Zin based on the first, third, seventh, tenth, eleventh, thirteenth, and fourteenth MOS transistors M1, M3, M7, M10, M11, M13 and M14 in FIG. 12 may be modeled such as Equation 5.

$$Z_{in} = C_{gs1} \parallel \frac{V_{in}}{I_{in}} \qquad \text{[Equation 5]}$$

Vin/Iin in Equation 5 may be re-expressed as Equation 6.

$$\frac{V_{in}}{I_{in}} = \frac{1 + C_{gd1}\dfrac{1}{r_{o1}\left\|\dfrac{1}{g_{m3}}\right\| Z_{v1}}}{C_{gd1}s\left(1 + 2g_{m1}\left(\dfrac{1}{r_{o1}\left\|\dfrac{1}{g_{m3}}\right\| Z_{v1}}\right)\right)} \qquad \text{[Equation 6]}$$

If substituting Equation 6 into Equation 5, the input impedance Zin is expressed such as Equation 7. In Equation 7, Av① means an amplifier input gain of the pre-amplifying unit STG1.

$$Z_{in} = \frac{1}{C_{gs1} + C_{gd1}s(1 + A^{v}_{①})} \qquad \text{[Equation 7]}$$

So, an input impedance ($Z_{in,closed}$) in the feedback circuit may be obtained as Equation 8 from a total small-signal model of the feedback circuit. In Equation 8, β is a feedback factor and means a magnitude which is fed back to the inverting input terminal 61 from the amplifier output terminal 63, and S means an angular frequency. And, Av means the amplifier output gain and is expressed as a multiplication of an amplifier input gain Av① of the pre-amplifying unit STG1, a gain Av② of the first gain amplifying unit STG2, and a gain Av③ of the second gain amplifying unit STG3.

$$Z_{in,closed} = \frac{(1 + \beta)A_v}{C_{gs1} + C_{gd1}s(1 + Av_{①})} \qquad \text{[Equation 8]}$$

$$A_v = Av_{①}A_{v②}A_{v③}$$

As can be clearly seen from Equation 8, the input impedance (Zin,closed) in the feedback circuit is inversely proportional to the amplifier input gain Av① and proportional to the amplifier output gain Av. That is, the input impedance (Zin,closed) increases as the amplifier input gain Av① decreases and the amplifier output gain Av increases. The present disclosure may implement a very high input impedance (Zin,closed), by lowering the amplifier input gain Av① through the pre-amplifying unit STG1 and increasing the gains of the gain amplifying units STG2 and STG3 on the rear end of the pre-amplifying unit STG1. According to the present disclosure, among the pixel current Ipix, the leakage current component Ileak flowing into inside of the operational amplifier AMP is reduced and an effective current component Tint applied to the feedback capacitor Cfb is increased, so an accurate sensing for the pixel current Ipix may be possible. If the sensing performance is improved, the driving characteristics of the OLED and/or the driving TFT may be accurately compensated.

Meanwhile, the small-signal modelings for the second, fourth, sixth, eighth, ninth, thirteenth and fourteenth MOS transistors M2, M4, M6, M8, M9, M13 and M14 may be analyzed based on the plus input voltage Vin+ according to the half circuit analyzing method in a same manner.

Figure 13:
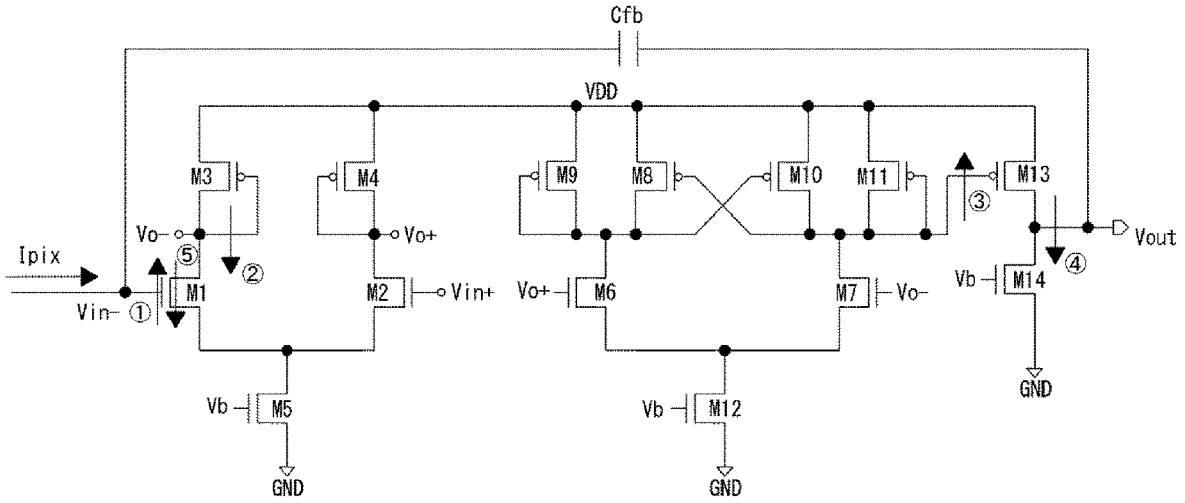
FIG. 13 is a diagram for explaining a schematic operation of the three-staged amplifier of FIG. 6.

FIG. 13 is a diagram for explaining a schematic operation of the three-staged amplifier of FIG. 6.

Referring to FIG. 13, in the three-staged amplifier AMP of the present disclosure, when the pixel current is applied through the sensing line, the gate voltage Vin− (that is, voltage ①) of the first MOS transistor M1 increases. When the gate voltage Vin− of the first MOS transistor M1 increases, the drain voltage (Voltage ②) of the third MOS transistor M3 is decreased. When the drain voltage of the third MOS transistor M3 decreases, the gate voltage (voltage ③) of the thirteenth MOS transistor M13 increases and the output voltage (integral voltage Vout) (voltage ④) decreases. When the output voltage Vout decreases, the gate voltage (voltage ⑤) of the first MOS transistor M1 decreases by the influence of negative feedback through the feedback capacitor Cfb. As described above, the three-staged amplifier AMP of the present disclosure senses the pixel current Ipix through the above-described negative feedback operation. Due to the effect of the increase of voltage ① and the decrease of voltage ⑤, the gate voltage Vin− of the first MOS transistor M1 becomes same as the gate voltage Vin+ of the second MOS transistor M2. At this time, the output voltage Vout becomes smaller than the gate voltage Vin+ of the second MOS transistor M2 by the pixel current Ipix accumulated in the feedback capacitor Cfb.

Figure 14:
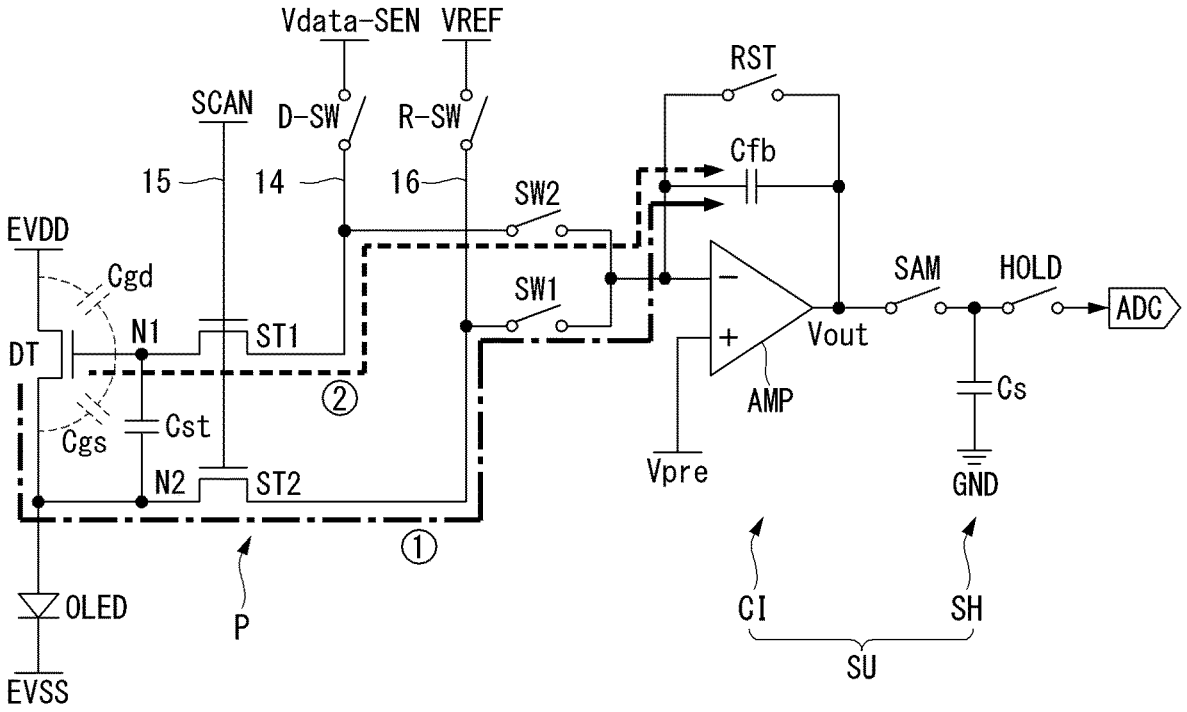
FIG. 14 is a diagram for explaining the operation of sensing characteristics of a driving TFT in a pixel, a total capacitance of capacitors connected to a gate electrode of the driving TFT by using a current integrator including the three-staged amplifier of FIG. 6.

FIG. 14 is a diagram for explaining the operation of sensing characteristics of a driving TFT in a pixel, a total capacitance of capacitors connected to a gate electrode of the driving TFT by using a current integrator including the three-staged amplifier of FIG. 6.

Referring to FIG. 14, the organic light emitting display device according to the present disclosure senses the pixel current of each pixel P and a total amount of charges accumulated in capacitors of each pixel P, by using the current integrator CI including the above-described three-staged amplifier AMP. The capacitors may include a first parasitic capacitor connected between the gate and drain electrodes of the driving TFT DT, a second parasitic capacitor connected between the gate and source electrodes of the driving TFT DT, a third parasitic capacitor connected between the gate and source electrodes of the first switch TFT ST1, and other parasitic capacitors, besides the storage capacitor.

The current integrator CI further includes a reset switch RST connected between an inverting input terminal (−) and an output terminal of the operational amplifier AMP. The reset switch RST may be connected to the feedback capacitor Cfb in parallel. The reset switch RST serves to initialize the voltage Vout of the output terminal of the operational amplifier AMP to an initial voltage Vpre of the non-inverting input terminal (+) before sensing. The initial voltage Vpre means the Vcm in FIG. 6.

The current integrator CI senses, through the sensing line 16, the pixel current flowing in each pixel P responding to the data voltage Vdata-SEN for sensing, and senses, through the data line 14, a total amount of charges accumulated in the capacitors Cst, Cgd and Cgs of each pixel P responding to the data voltage Vdata-SEN for sensing. A first sensing path ① through the sensing line 16 and a second sensing path ② through the data line 14 are selectively activated. That is, when the first sensing path ① is activated, the second sensing path ② is inactivated, and on the contrary when the second sensing path ② is activated, the first sensing path ① is inactivated.

To this end, the organic light emitting display device of the present disclosure further includes a switch D-SW for supplying data, a switch R-SW for supplying a reference voltage, a switch SW1 for the first sensing path and a switch SW2 for the second sensing path. The switch D-SW for supplying data is connected between each data line 14 and an output terminal of the data driving circuit 12 through which the data voltage Vdata-SEN for sensing is output. The switch R-SW for supplying a reference voltage is connected between each sensing line 16 and an output terminal of the data driving circuit 12 through which the reference voltage VREF is output. The switch SW1 for the first sensing path is connected between each sensing line 16 and the inverting input terminal (−) of the operational amplifier AMP constituting the current integrator CI. The switch SW2 for the second sensing path is connected between each data line 14 and the inverting input terminal (−) of the operational amplifier AMP.

Figure 16:
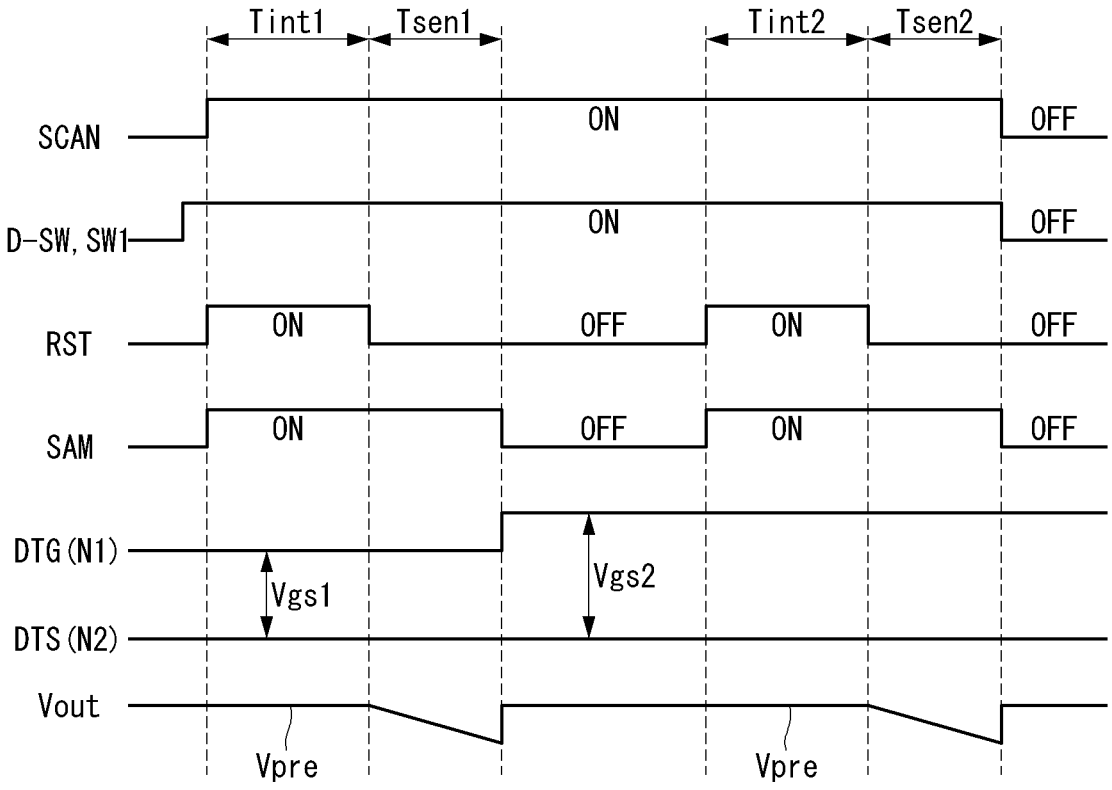
FIG. 16 shows waveforms of driving signals for sensing the characteristics of the driving TFT.

In the sensing unit SU of the present disclosure, the switch D-SW for supplying data and the switch SW1 for the first sensing path maintain their turn-on states, and the switch R-SW for supplying the reference voltage and the switch SW2 for the second sensing path maintain their turn-off states, while sensing the pixel current of each pixel P (referring to Tsen1 and Tsen2 in FIG. 16). And, in the sensing unit SU of the present disclosure, the switch R-SW for supplying the reference voltage and the switch SW2 for the second sensing path maintain their turn-on states, and the switch D-SW for supplying data and the switch SW1 for the first sensing path maintain their turn-off states, while sensing a total amount of charges accumulated in the capacitors Cst, Cgd and Cgs of each pixel P (referring to Tsen in FIG. 17).

Meanwhile, the sensing unit SU of the present disclosure may further include a sample&hold unit SH for sampling and holding an integral voltage Vout of the current integrator CI. The sample&hold unit SH is equipped with a sampling switch SAM and a holding switch HOLD which are connected in series between the current integrator CI and an analog-to-digital converter ADC, and a sampling capacitor Cs connected between a ground voltage source GND and a node connected in the middle of two serially connected switches SAM and HOLD.

Figure 15:
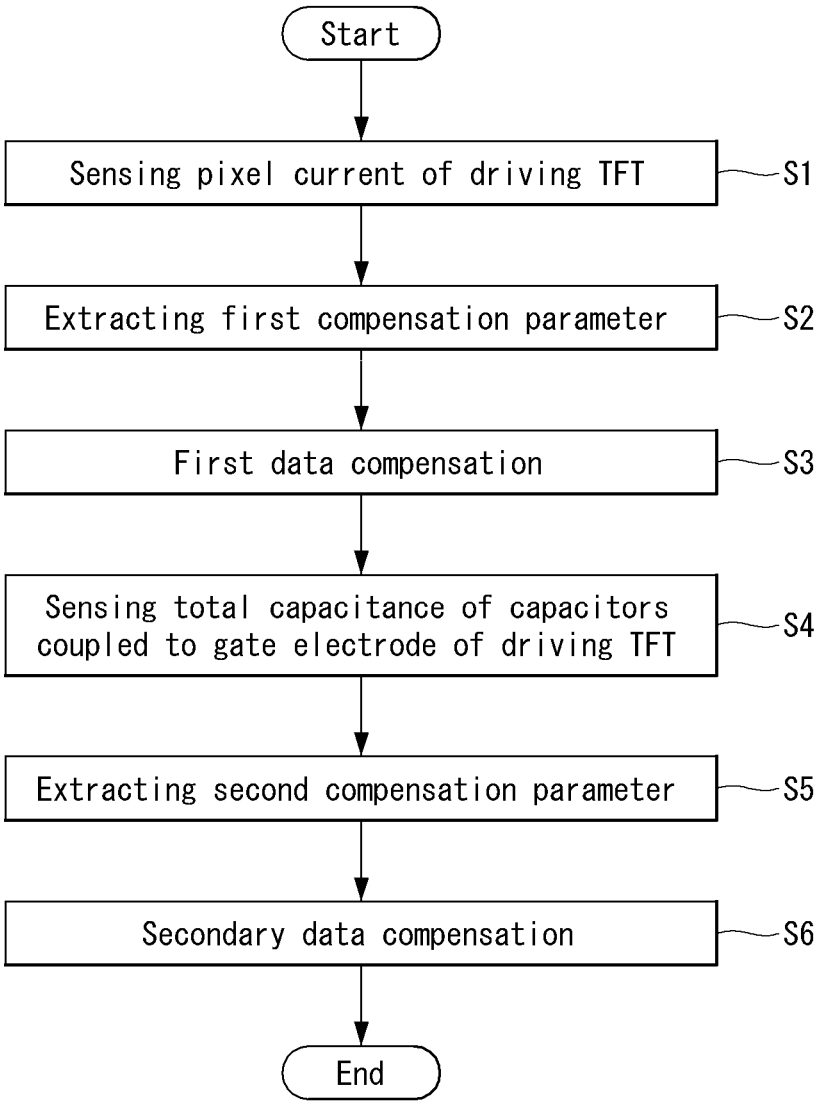
FIG. 15 shows a flowing chart showing the pixel compensating method of an organic light emitting display device according to the present disclosure.
Figure 17:
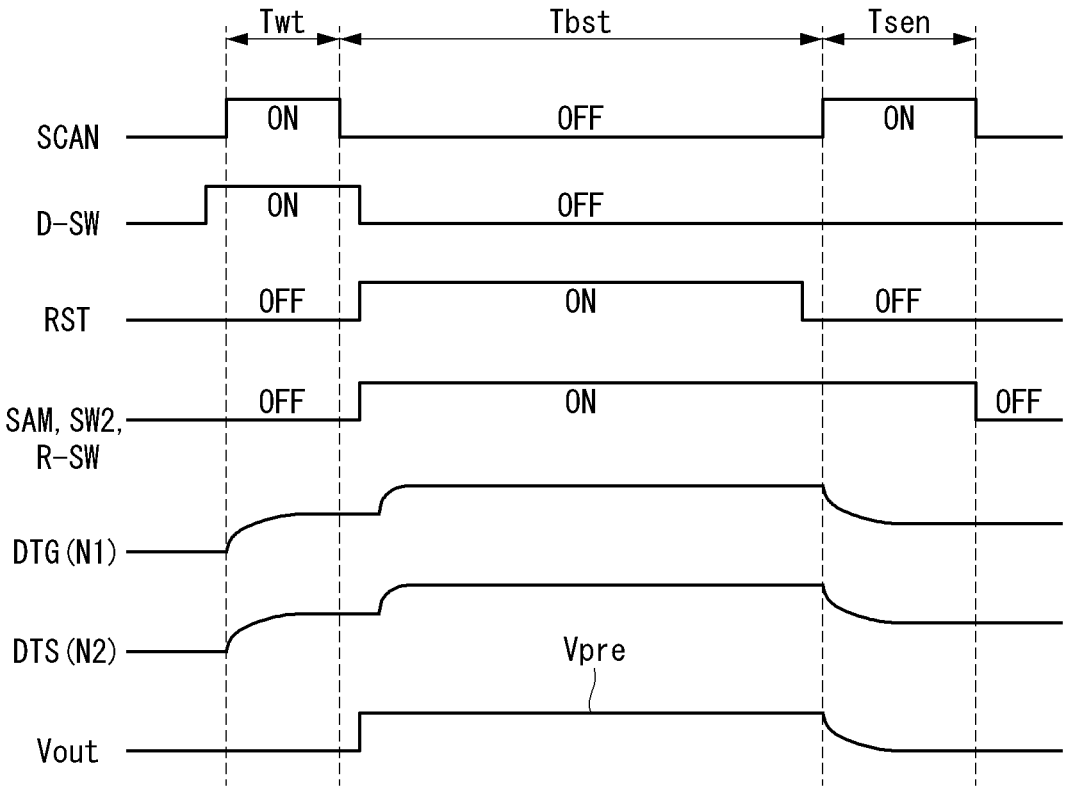
FIG. 17 shows waveforms of driving signals for sensing the total capacitance of the capacitors connected to the gate electrode of the driving TFT.

FIG. 15 shows a flowing chart showing the pixel compensating method of an organic light emitting display device according to the present disclosure, FIG. 16 shows waveforms of driving signals for sensing the characteristics of the driving TFT, and FIG. 17 shows waveforms of driving signals for sensing the total capacitance of the capacitors connected to the gate electrode of the driving TFT. The pixel compensation method of the organic light emitting display according to the embodiment of the present disclosure will be described with reference to FIG. 14. Referring to FIGS. 14 to 16, the pixel compensation method senses a pixel current for a low grayscale flowing through the driving TFT DT in a first initializing period Tint1 and a first sensing period Tsen1, and senses a pixel current for a high grayscale flowing through the driving TFT DT in a second initializing period Tint2 and a second sensing period Tsen2 (S1). The reason for sensing the pixel current twice is to find out both the threshold voltage change and the electron mobility change of the driving TFT DT.

In the first initializing period Tint1, the first and second switch TFTs ST1 and ST2 are turned on responding to the scan control signal SCAN, and the reset switch RST and the sampling switch SAM of the sensing unit SU are turned on. Also, the switch D-SW for supplying data and the switch SW1 for the first sensing path are turned on. So, the gate-source voltage Vgs1 of the driving TFT DT is set as a difference between the data voltage Vdata-SEN for sensing and the initial voltage Vpre, and a first pixel current corresponding to the gate-source voltage Vgs1 flows through the driving TFT DT.

In the first sensing period Tsen1, the first and second switch TFTs ST1 and ST2, the switch D-SW for supplying data, the switch SW1 for the first sensing path and the sampling switch SAM maintain their turn-on states, and the reset switch RST is turned to a turn-off state. So, the sensing unit SU integrates the first pixel current and outputs a first integral voltage Vout which decreases from the initial voltage Vpre. The first integral voltage Vout is sampled and held in the sample&hold unit SH and then converted into a first sensing result value through the ADC, and the first sensing result value is output to the timing controller 11.

In the second initializing period Tint2, the first and second switch TFTs ST1 and ST2 are turned on responding to the scan control signal SCAN, and the reset switch RST and the sampling switch SAM of the sensing unit SU are turned on. Also, the switch D-SW for supplying data and the switch SW1 for the first sensing path are turned on. So, the gate-source voltage Vgs2 of the driving TFT DT is set as a difference between the data voltage Vdata-SEN for sensing and the initial voltage Vpre, and a second pixel current corresponding to the gate-source voltage Vgs2 flows through the driving TFT DT.

In the second sensing period Tsen2, the first and second switch TFTs ST1 and ST2, the switch D-SW for supplying data, the switch SW1 for the first sensing path and the sampling switch SAM maintain their turn-on states, and the reset switch RST is turned to the turn-off state. So, the sensing unit SU integrates the second pixel current and outputs a second integral voltage Vout which decreases from the initial voltage Vpre. The second integral voltage Vout is sampled and held in the sample&hold unit SH and then converted into a second sensing result value through the ADC, and the second sensing result value is output to the timing controller 11.

The timing controller 11 compares the first and second sensing result values with previous sensing result values and calculates or extracts a first compensation parameter for compensating for the threshold voltage change and the electron mobility change of the driving TFT DT (S2).

The timing controller 11 firstly compensates for digital image data DATA to be written to the pixels P based on the first compensation parameter (S3).

Referring to FIGS. 14, 15 and 17, the pixel compensation method of the organic light emitting display device according to an embodiment of the present disclosure, senses a total charge amount of the capacitors Cst, Cgd and Cgs coupled to the gate electrode of the driving TFT DT in a data writing period Twt, a boosting period Tbst and a sensing period Tsen (S4).

In the data writing period Twt, the first and second switch TFTs ST1 and ST2 and the switch D-SW for supplying data are turned on, and the switch R-SW for supplying the reference voltage, the switch SW2 for the second sensing path and the sampling switch SAM are turned off. So, charges are accumulated in the capacitors Cst, Cgd and Cgs coupled to the gate electrode of the driving TFT DT according to the data voltage Vdata-SEN for sensing.

In the boosting period Tbst, the first and second switch TFTs ST1 and ST2 and the switch D-SW for supplying data are turned off, and the switch R-SW for supplying the reference voltage, the switch SW2 for the second sensing path and the sampling switch SAM are turned on. So, the gate-source voltage of the driving TFT DT is set as a difference between the data voltage Vdata-SEN for sensing and the reference voltage VREF, and a pixel current corresponding to the gate-source voltage flows through the driving TFT DT. A voltage DTG of the gate electrode of the driving TFT DT and a voltage DTS of the source electrode of the driving TFT DT are boosted while maintaining the gate-source voltage by the pixel current.

In the sensing period Tsen, the first and second switch TFTs ST1 and ST2 are turned on, the switch D-SW for supplying data maintains its turn-off state, and the switch R-SW for supplying the reference voltage, the switch SW2 for the second sensing path and the sampling switch SAM maintains their turn-on states. So, the sensing unit SU integrates the boosted voltage DTG of the gate electrode of the driving TFT DT and outputs an integral voltage Vout which decreases from the initial voltage Vpre. The integral voltage Vout is sampled and held in the sample&hold unit SH and then converted into a sensing result value through the ADC, and the sensing result value is output to the timing controller 11.

The timing controller 11 compares the sensing result values with previous sensing result values and calculates or extracts a second compensation parameter for compensating for a capacitance deviation of the capacitors coupled to the gate electrode of the driving TFT DT (S5).

The timing controller 11 further compensates for digital image data DATA to be written to the pixels P based on the second compensation parameter (S6).

As described above, the present disclosure implements a very high input impedance by lowering the amplifier input gain via the pre-amplifying unit and increasing the gains of the gain amplifying units on the rear end of the pre-amplifying unit. According to the present disclosure, among the pixel current, the leakage current component flowing into the operational amplifier is reduced and the effective current component applied to the feedback capacitor is increased, so an accurate sensing for the pixel current may be possible. If the sensing performance is improved, the driving characteristics of the OLED and/or the driving TFT may be accurately compensated.

The present disclosure may remarkably improve the compensation performance by further compensating not only the characteristic deviation of the driving TFT but also the capacitance deviation connected to the gate electrode of the driving TFT.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A pixel sensing device, comprising:

a plurality of current integrators for sensing driving characteristics of pixels, each of the current integrators including:

an operational amplifier having an inverting input terminal configured to receive a first input voltage according to a pixel current of the pixels, a non-inverting input terminal configured to receive a second input voltage according to the pixel current, and an output terminal configured to output an integral voltage corresponding to the pixel current; and a feedback capacitor connected between the inverting input terminal and the output terminal, wherein the operational amplifier includes:

a pre-amplifying circuit configured to lower an amplifier input gain, the pre-amplifying circuit including the inverting and non-inverting input terminals; and two gain amplifying circuits configured to receive an output of the pre-amplifying circuit and increase an amplifier output gain to a level that is higher than the amplifier input gain, wherein the two gain amplifying circuits includes:

a first gain amplifying circuit configured to receive the output of the pre-amplifying circuit and increase the amplifier output gain by a first value through MOS transistors connected in a differential diode manner; and a second gain amplifying circuit connected to the first gain amplifying circuit, the second gain amplifying circuit including the output terminal, and configured to increase the amplifier output gain by a second value which is less than the first value, and wherein the pre-amplifying circuit includes:

a first MOS transistor having a gate electrode connected to the inverting input terminal, a drain electrode connected to a first node, and a source electrode connected to a second node;

a second MOS transistor having a gate electrode connected to the non-inverting input terminal, a drain electrode connected to a third node, and a source electrode connected to the second node;

a third MOS transistor having gate and drain electrodes connected to the first node, and a source electrode connected to a high potential driving voltage source;

a fourth MOS transistor having gate and drain electrodes connected to the third node, and a source electrode connected to the high potential driving voltage source; and a fifth MOS transistor equipped having a gate electrode connected to a bias voltage source, a drain electrode connected to the second node, and a source electrode connected to a low potential driving voltage source.

2. The pixel sensing device of claim 1, wherein an inverting output voltage of the pre-amplifying circuit is output through the first node, and a non-inverting output voltage of the pre-amplifying circuit is output through the third node, and wherein the first, second and fifth MOS transistors are implemented as N-type transistors, and the third and fourth MOS transistors are implemented as P-type transistors.

3. The pixel sensing device of claim 1, wherein the first gain amplifying circuit comprises:

a sixth MOS transistor having a gate electrode connected to the third node, a drain electrode connected to a fourth node, and a source electrode connected to a fifth node;

a seventh MOS transistor having a gate electrode connected to the first node, a drain electrode connected to a sixth node, and a source electrode connected to the fifth node;

an eighth MOS transistor having a gate electrode connected to the sixth node, a drain electrode connected to the fourth node, and a source electrode connected to the high potential driving voltage source;

a ninth MOS transistor having gate and drain electrodes connected to the fourth node, and a source electrode connected to the high potential driving voltage source;

a tenth MOS transistor having a gate electrode connected to the fourth node, a drain electrode connected to the sixth node, and a source electrode connected to the high potential driving voltage source;

an eleventh MOS transistor having gate and drain electrodes connected to the sixth node, and a source electrode connected to the high potential driving voltage source; and a twelfth MOS transistor having a gate electrode connected to the bias voltage source, a drain electrode connected to the fifth node, and a source electrode connected to the low potential driving voltage source.

4. The pixel sensing device of claim 3, wherein the sixth, seventh and twelfth MOS transistors are implemented as N-type transistors, and the eighth, ninth, tenth and eleventh MOS transistors are implemented as P-type transistors.

5. The pixel sensing device of claim 3, wherein the second gain amplifying circuit comprises:

a thirteenth MOS transistor having a gate electrode connected to the sixth node, a drain electrode connected to the output terminal, and a source electrode connected to the high potential driving voltage source; and a fourteenth MOS transistor having a gate electrode connected to the bias voltage source, a drain electrode connected to the output terminal, and a source electrode connected to the low potential driving voltage source.

6. The pixel sensing device of claim 1, wherein an input impedance of the operational amplifier is proportional to the amplifier output gain and inversely proportional to the amplifier input gain.

7. The pixel sensing device of claim 1, wherein each current integrator senses the pixel current which flows through a driving TFT of each pixel in response to a data voltage for sensing, and senses a total amount of charges accumulated in capacitors of each pixel in response to the data voltage for sensing.

8. The pixel sensing device of claim 5, wherein the thirteenth MOS transistor is implemented as a P-type transistor, and the fourteenth MOS transistor is implemented as an N-type transistor.

9. The pixel sensing device of claim 1, wherein when the pixel current is applied, the integral voltage of the operational amplifier decreases, a gate voltage of the first MOS transistor decreases based on negative feedback through the feedback capacitor, and the integral voltage is smaller than a gate voltage of the second MOS transistor by the pixel current accumulated in the feedback capacitor.

10. An organic light emitting display device, comprising:

a display panel including pixels and sensing lines and data lines connected to the pixels;

a data driving circuit configured to supply a data voltage for sensing to the data lines;

a pixel sensing device including a plurality of current integrators for sensing driving characteristics of pixels, a timing controller configured to compensate for digital image data to be written on the display panel based on a sensing result of the pixel sensing device, a first switch connected between each data line and an output terminal of the data driving circuit through which the data voltage for sensing is output;

a second switch connected to each sensing line and an output terminal of the data driving circuit through which a reference voltage is output;

a third switch connected between each sensing line and the inverting input terminal of the operational amplifier included in the pixel sensing device; and a fourth switch connected between each data line and the inverting input terminal of the operational amplifier included in the pixel sensing device, wherein each of the current integrators includes:

an operational amplifier having an inverting input terminal configured to receive a first input voltage according to a pixel current of the pixels, a non-inverting input terminal configured to receive a second input voltage according to the pixel current, and an output terminal configured to output an integral voltage corresponding to the pixel current; and a feedback capacitor connected between the inverting input terminal and the output terminal, wherein the operational amplifier includes:

a pre-amplifying circuit configured to lower an amplifier input gain, the pre-amplifying circuit including the inverting and non-inverting input terminals; and two gain amplifying circuits configured to receive an output of the pre-amplifying circuit and increase an amplifier output gain to a level that is higher than the amplifier input gain; and wherein the pixel sensing device is configured to sense, through the sensing lines, the pixel current which flows in each pixel in response to the data voltage for sensing, and sense, through the data lines, a total amount of charges accumulated in capacitors of each pixel in response to the data voltage for sensing, wherein during a period in which the pixel sensing device senses the pixel current of each pixel, the first and third switches maintain turn-on states, and the second and fourth switches maintain turn-off states, and wherein during a period in which the pixel sensing device senses the total amount of charges accumulated in the capacitors of each pixel, the second and fourth switches maintain turn-on states, and the first and third switches maintain turn-off states.

11. The organic light emitting display device of claim 10, wherein the capacitors of each pixel include a storage capacitor and a parasitic capacitor coupled to a gate electrode of a driving TFT included in each pixel.

12. The organic light emitting display device of claim 10, wherein the timing controller is configured to:

calculate a first compensation parameter corresponding to a first sensing result of the pixel sensing device for the pixel current, and compensate for the digital image data to be written on the display panel based on the first compensation parameter, and calculate a second compensation parameter corresponding to a second sensing result of the pixel sensing device for the pixel current, and further compensate for the digital image data to be written on the display panel based on the second compensation parameter.

13. A pixel compensation method of an organic light emitting display device, the organic light emitting display device comprising: pixels; a pixel sensing device connected the pixels through sensing lines and data lines, a data driving circuit for supplying a data voltage for sensing to the data lines, and a timing controller for compensating for digital image data to be written to the pixels based on a sensing result of the pixel sensing device, the pixel compensation method comprising:

sensing, by the pixel sensing device, through the sensing lines, a pixel current which flows in each pixel in response to the data voltage for sensing;

calculating, by the timing controller, a first compensation parameter corresponding to a first sensing result of the pixel sensing device for the pixel current, and compensating for the digital image data to be written to the pixels based on the first compensation parameter;

sensing, by the pixel sensing device, through the data lines, a total amount of charges accumulated in capacitors of each pixel in response to the data voltage for sensing; and calculating, by the timing controller, a second compensation parameter corresponding to a second sensing result of the pixel sensing device for the pixel current, and further compensating for the digital image data to be written to the pixels based on the second compensation parameter.

14. The pixel compensation method of claim 13, wherein the capacitors of each pixel include a storage capacitor and a parasitic capacitor coupled to a gate electrode of a driving TFT included in each pixel.

* * * * *